US009388667B2

(12) United States Patent
Orrego et al.

(10) Patent No.: US 9,388,667 B2
(45) Date of Patent: Jul. 12, 2016

(54) HEATING PRODUCTION FLUIDS IN A WELLBORE

(71) Applicants: Yamila Orrego, Houston, TX (US); Todd A. Jankowski, Los Alamos, NM (US)

(72) Inventors: Yamila Orrego, Houston, TX (US); Todd A. Jankowski, Los Alamos, NM (US)

(73) Assignees: CHEVRON U.S.A. INC., San Ramon, CA (US); LOS ALAMOS NATIONAL SECURITY, LLC., Los Alamos, NM (US)

( * ) Notice: Subject to any disclaimer, the term of this patent is extended or adjusted under 35 U.S.C. 154(b) by 474 days.

(21) Appl. No.: 13/923,770

(22) Filed: Jun. 21, 2013

(65) Prior Publication Data

US 2014/0374101 A1 Dec. 25, 2014

(51) Int. Cl.
*E21B 36/00* (2006.01)

(52) U.S. Cl.
CPC ..... *E21B 36/005* (2013.01)

(58) Field of Classification Search
None
See application file for complete search history.

(56) References Cited

U.S. PATENT DOCUMENTS

| | | | | |
|---|---|---|---|---|
| 2,148,717 | A * | 2/1939 | Whitney | E21B 43/24 166/245 |
| 2,705,535 | A | 4/1955 | Waterman | |
| 3,228,471 | A | 1/1966 | Shook | |
| 3,908,763 | A * | 9/1975 | Chapman | E21B 37/00 166/302 |
| 4,328,865 | A | 5/1982 | Hall | |
| 2002/0104651 | A1 | 8/2002 | McClung | |
| 2004/0112601 | A1 * | 6/2004 | Hache | E21B 36/001 166/302 |
| 2013/0180708 | A1 * | 7/2013 | Ware | E21B 43/2406 166/246 |

OTHER PUBLICATIONS

International Search Report for PCT/US2014/043574, mailed Mar. 24, 2015.

* cited by examiner

*Primary Examiner* — Jennifer H Gay
*Assistant Examiner* — Caroline Butcher
(74) *Attorney, Agent, or Firm* — King & Spalding LLP

(57) ABSTRACT

A method for heating a production fluid in a wellbore. The method can include heating, using a packer fluid, a working fluid flowing through a first medium disposed in a first section of the wellbore, where the first medium transfers heat from the packer fluid to the working fluid. The method can also include circulating the working fluid into a second section of the wellbore through a second medium, where the second medium transfers heat from the working fluid to the production fluid. The method can further include returning the working fluid to the first section of the wellbore through the first medium.

18 Claims, 3 Drawing Sheets

HEATING PRODUCTION FLUIDS IN A WELLBORE

ACKNOWLEDGMENT OF GOVERNMENT SUPPORT

This invention was made with government support under Contract No. DEAC52-06NA25396 awarded by the U.S. Department of Energy. The government has certain rights in the invention.

PARTIES TO JOINT RESEARCH AGREEMENT

The present disclosure relates generally to the application of heat into a subterranean wellbore. The research work described here was performed under a Cooperative Research and Development Agreement (CRADA) between Los Alamos National Laboratory (LANL) and Chevron under the LANL-Chevron Alliance, CRADA number LA05C10518.

TECHNICAL FIELD

The present disclosure relates generally to the application of heat into a subterranean wellbore.

BACKGROUND

In the production of oil and gas from a wellbore, it is sometimes necessary to employ pumps or other apparatus deep within the well for the purpose of pumping downhole fluids such as oil and gas vertically upwards for production from the wellbore. Such fluids can be easier to pump or otherwise extract from a subterranean formation when they are heated. In other words, applying heat to a downhole fluid can reduce the viscosity of the fluid.

Subterranean wellbores may be drilled and constructed several miles below the ground or seabed. It is difficult or inconvenient to deliver electrical power to downhole equipment in such harsh environments. When the viscosity of a downhole fluid is lowered, a pump motor assembly and/or other extraction equipment located in a wellbore does not have to work as hard to remove such downhole fluid. In other words, less electrical power can be delivered to downhole extraction equipment to transport the downhole fluid to the surface.

SUMMARY

In general, in one aspect, the disclosure relates to a method for heating a production fluid in a wellbore. The method can include heating, using a packer fluid, a working fluid flowing through a first medium disposed in a first section of the wellbore, where the first medium transfers heat from the packer fluid to the working fluid. The method can also include circulating the working fluid into a second section of the wellbore through a second medium, where the second medium transfers heat from the working fluid to the production fluid. The method can further include returning the working fluid to the first section of the wellbore through the first medium.

In another aspect, the disclosure can generally relate to a system for heating a production fluid in a wellbore. The system can include casing disposed within the wellbore and having a number of perforations for receiving the production fluid from a reservoir adjacent to the perforations. The system can also include tubing disposed within the casing and having an open distal end. The system can further include a packer disposed between the tubing and the casing at a point above the open distal end of the tubing, where the packer creates a first section above the packer and a second section below the packer, where the perforations are disposed within the second section. The system can also include an evaporator disposed in the first section between the tubing and the casing, where the evaporator includes a first channel through which a working fluid flows, where the evaporator transfers heat from a packer fluid in the first section to the working fluid. The system can further include a condenser mechanically coupled, through the packer, to the evaporator and disposed in the second section between the tubing and the casing, where the condenser includes a second channel through which a working fluid flows, where the condenser transfers heat from the working fluid to the production fluid in the second section.

These and other aspects, objects, features, and embodiments will be apparent from the following description and the appended claims.

BRIEF DESCRIPTION OF THE DRAWINGS

The drawings illustrate only example embodiments of methods, systems, and devices for heating production fluids in a wellbore (also called herein a "borehole") and are therefore not to be considered limiting of its scope, as heating production fluids in a wellbore may admit to other equally effective embodiments. The elements and features shown in the drawings are not necessarily to scale, emphasis instead being placed upon clearly illustrating the principles of the example embodiments. Additionally, certain dimensions or positionings may be exaggerated to help visually convey such principles. In the drawings, reference numerals designate like or corresponding, but not necessarily identical, elements.

DETAILED DESCRIPTION OF EXAMPLE EMBODIMENTS

Figure 1:
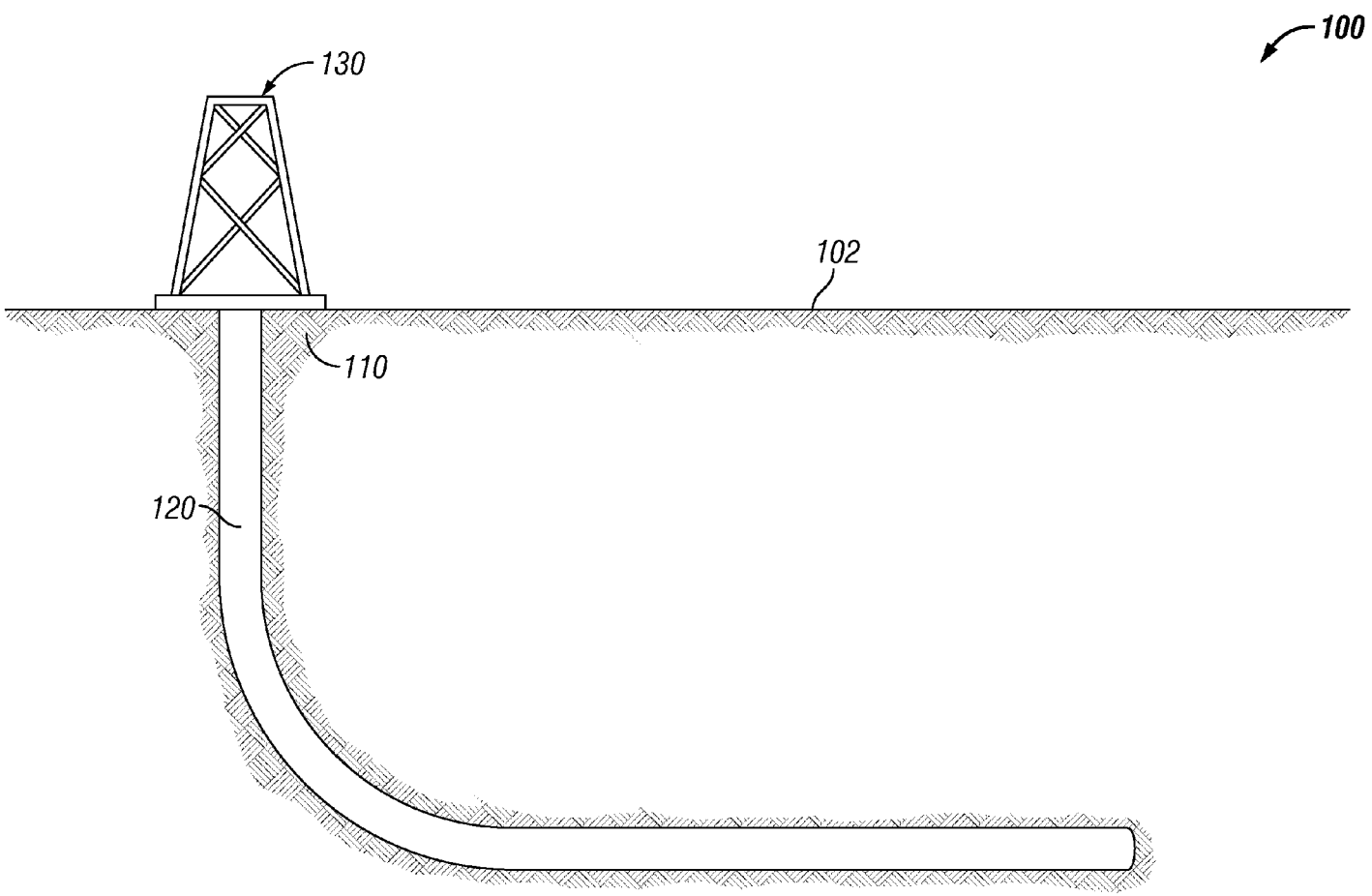
FIG. 1 shows a schematic diagram of a field system that can heat production fluid in a wellbore in accordance with certain example embodiments.

Example embodiments directed to heating production fluids in a wellbore will now be described in detail with reference to the accompanying figures. Like, but not necessarily the same or identical, elements in the various figures are denoted by like reference numerals for consistency. In the following detailed description of the example embodiments, numerous specific details are set forth in order to provide a more thorough understanding of the disclosure herein. However, it will be apparent to one of ordinary skill in the art that the example embodiments herein may be practiced without these specific details. In other instances, well-known features have not been described in detail to avoid unnecessarily complicating the description. As used herein, a length, a width, and a height can each generally be described as lateral directions.

In certain example embodiments, production fluid as described herein is one or more of any solid, liquid, and/or vapor that can be found in a subterranean formation. Examples of a production fluid can include, but are not limited to, crude oil, natural gas, water, steam, and hydrogen gas. Production fluid can be called other names, including but not limited to downhole fluid, reservoir fluid, a resource, and a field resource.

A user as described herein may be any person that is involved with extracting and/or controlling one or more production fluids in a wellbore of a subterranean formation of a field. Examples of a user may include, but are not limited to, a company representative, a drilling engineer, a tool pusher, a service hand, a field engineer, an electrician, a mechanic, an operator, a consultant, a contractor, a roughneck, and a manufacturer's representative.

FIG. 1 shows a schematic diagram of a field system 100 that can heat production fluid in a subterranean wellbore in accordance with one or more example embodiments. In one or more embodiments, one or more of the features shown in FIG. 1 may be omitted, added, repeated, and/or substituted. Accordingly, embodiments of a field system should not be considered limited to the specific arrangements of components shown in FIG. 1.

Referring now to FIG. 1, the field system 100 in this example includes a wellbore 120 that is formed in a subterranean formation 110 using field equipment 130 above a surface 102, such as ground level for an on-shore application and the sea floor for an off-shore application. The point where the wellbore 120 begins at the surface 102 can be called the entry point. The subterranean formation 110 can include one or more of a number of formation types, including but not limited to shale, limestone, sandstone, clay, sand, and salt. In certain embodiments, a subterranean formation 110 can also include one or more reservoirs in which one or more resources (e.g., oil, gas, water, steam) can be located. One or more of a number of field operations (e.g., drilling, setting casing, extracting production fluids) can be performed to reach an objective of a user with respect to the subterranean formation 110.

The wellbore 120 can have one or more of a number of segments, where each segment can have one or more of a number of dimensions. Examples of such dimensions can include, but are not limited to, size (e.g., diameter) of the wellbore 120, a curvature of the wellbore 120, a total vertical depth of the wellbore 120, a measured depth of the wellbore 120, and a horizontal displacement of the wellbore 120. The field equipment 130 can be used to create and/or develop (e.g., extract production fluids from) the wellbore 120. The field equipment 130 can be positioned and/or assembled at the surface 102. The field equipment 130 can include, but is not limited to, a derrick, a tool pusher, a clamp, a tong, drill pipe, a drill bit, example systems for heating production fluid, tubing pipe, a power source, a packer, and casing pipe. The field equipment 130 can also include one or more devices that measure and/or control various aspects (e.g., direction of wellbore 120, pressure, temperature) of a field operation associated with the wellbore 120. For example, the field equipment 130 can include a wireline tool that is run through the wellbore 120 to provide detailed information (e.g., curvature, azimuth, inclination) throughout the wellbore 120. Such information can be used for one or more of a number of purposes. For example, such information can dictate the size (e.g., outer diameter) of a casing pipe to be inserted at a certain depth in the wellbore 120.

Figure 2:
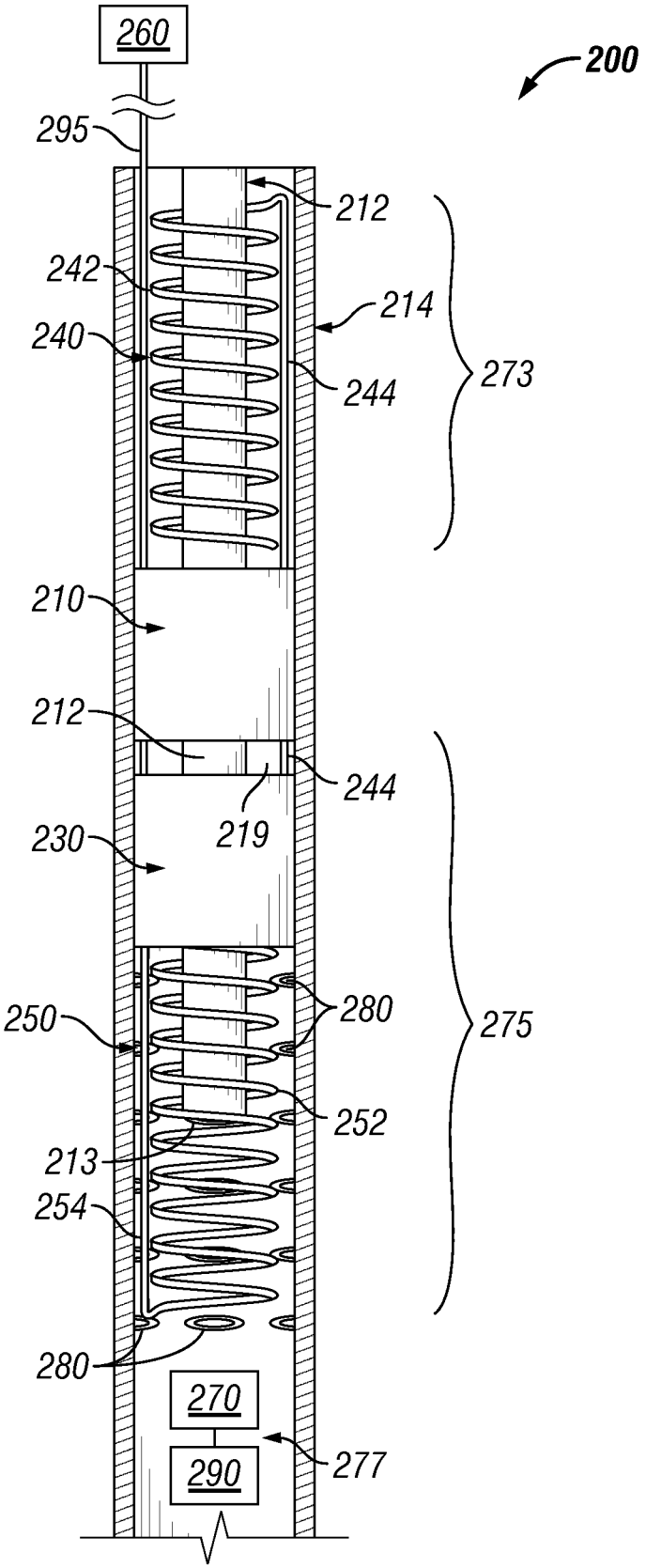
FIG. 2 shows a system for heating a production fluid in a wellbore in accordance with certain example embodiments.

FIG. 2 shows a system 200, in partial cross section, for heating a production fluid in a wellbore in accordance with certain example embodiments. In one or more embodiments, one or more of the features shown in FIG. 2 may be omitted, added, repeated, and/or substituted. Accordingly, embodiments of a system for heating a production fluid should not be considered limited to the specific arrangements of components shown in FIG. 2.

The system 200 can include a casing 214, tubing 212, an evaporator 240, a condenser 250, a packer 210, and an optional a power cable 295. Referring to FIGS. 1 and 2, the casing 214 can include a number of casing pipes that are mechanically coupled to each other end-to-end, usually with mating threads. The casing pipes of the casing 214 can be mechanically coupled to each other directly or using a coupling device, such as a coupling sleeve.

Each casing pipe of the casing 214 can have a length and a width (e.g., outer diameter). The length of a casing pipe can vary. For example, a common length of a casing pipe is approximately 40 feet. The length of a casing pipe can be longer (e.g., 60 feet) or shorter (e.g., 10 feet) than 40 feet. The width of a casing pipe can also vary and can depend on the cross-sectional shape of the casing pipe. For example, when the cross-sectional shape of the casing pipe is circular, the width can refer to an outer diameter, an inner diameter, or some other form of measurement of the casing pipe. Examples of a width in terms of an outer diameter can include, but are not limited to, 7 inches, 7⅝ inches, 8⅝ inches, 10¾ inches, 13⅜ inches, and 14 inches.

The size (e.g., width, length) of the casing 214 is determined based on the information gathered using field equipment 130 with respect to the wellbore 120. The walls of the casing 214 have an inner surface that forms a cavity 219 that traverses the length of the casing 214. The casing 214 can be made of one or more of a number of suitable materials, including but not limited to steel. In certain example embodiments, the casing 214 is set along substantially all of the length of the wellbore 120.

The tubing 212 (sometimes called a tubing string) can include a number of tubing pipes that are mechanically coupled to each other end-to-end, usually with mating threads. The tubing pipes of the tubing string 212 can be mechanically coupled to each other directly or using a coupling device, such as a coupling sleeve. In some cases, more than one tubing string can be disposed within a cavity 219 of the casing 214.

Each tubing pipe of the tubing string 212 can have a length and a width (e.g., outer diameter). The length of a tubing pipe can vary. For example, a common length of a tubing pipe is approximately 30 feet. The length of a tubing pipe can be longer (e.g., 40 feet) or shorter (e.g., 10 feet) than 30 feet. The width of a tubing pipe can also vary and can depend on one or more of a number of factors, including but not limited to the inner diameter of the casing pipe. For example, the width of the tubing pipe is less than the inner diameter of the casing pipe. The width of a tubing pipe can refer to an outer diameter, an inner diameter, or some other form of measurement of the tubing pipe. Examples of a width in terms of an outer diameter can include, but are not limited to, 7 inches, 5 inches, and 4 inches.

The distal end 213 of the tubing 212 can be located toward the bottom of the wellbore 120. In certain example embodiments, the distal end 213 of the tubing is open (substantially unobstructed) and is positioned within the cavity 219 of the wellbore 214. In other words, the casing 214 can extend further into the wellbore 120 than the tubing 212. The size (e.g., outer diameter, length) of the tubing 212 can be determined based, in part, on the size of the cavity 219 within the casing 214. The walls of the tubing 212 have an inner surface that forms a cavity (not shown in FIG. 2) that traverses the length of the tubing 212. The tubing 212 can be made of one or more of a number of suitable materials, including but not limited to steel. The one or more materials of the tubing 212 can be the same or different than the materials of the casing 214.

The packer 210 of FIG. 2 is positioned within the cavity 219 of the casing 214 and around the exterior of the tubing 212. The packer 210 can provide a seal between the inner wall of the casing 214 and the outer wall of the tubing 212. In such a case, the packer separates the cavity 219 into a first section 273 (e.g., above the packer) and a second section 275 (e.g., below the packer). The packer 210 can be positioned toward the bottom of the wellbore 120 above but proximate to where the production fluid 282 can be extracted. Further, the packer 210 can be disposed at a point above the open distal end 213 of the tubing 212. For example, as shown in FIG. 2, the packer 210 can be positioned above the perforations 280 made in the casing 214. Such perforations 280 allow the production fluid 282 to enter the cavity 219 in the second section 275 from a reservoir in the field. The perforations 280 can be made using one or more of a number of perforating technologies currently used or to be discovered with respect to a field operation.

Packer fluid can be positioned in the cavity 219 in the first section 273. Packer fluid as used herein describes a fluid disposed between the casing and the tubing that is confined to a certain portion of the wellbore. Packer fluid can include one or more of a number of solutions. Examples of packer fluid can include, but is not limited to, water-based muds, oil-based muds, and solid-free brine solution. The packer fluid has a temperature that is higher than a temperature of the working fluid when the working fluid is in liquid form flowing through the evaporator entrance end 242 of the evaporator 240.

In certain example embodiments, the wall of the packer 210 includes one or more passages through which components of the system 200 for heating production fluid in the wellbore 120 can traverse. For example, the optional power cable 295 can traverse a passage in the packer 210 to supply power from a power source in (or beyond) the first section 273 to an electrical device (e.g., a compressor) positioned in the equipment housing 230 in the second section 275. As another example, as shown in FIG. 2, portions of the evaporator 240, predominately positioned in the first section 273, can traverse a passage in the packer 210 to mechanically couple to the compressor and/or the expansion valve in the equipment housing 230 in the second section 275.

The packer 210 can be set in place within the cavity 219 using one or more of a number of features. For example, slips or other types of metal wedges can be used to dig into the inner wall of the casing 214. The packer 210 can be made from one or more of a number of materials, including but not limited to metal, rubber, and plastic. More than one packer 210 can be used in a wellbore 120. In such a case, the multiple packers 210 can be positioned consecutively or at some distance from each other. In the latter case, each additional packer 210 can create one or more additional sections of the cavity 219.

In certain example embodiments, the evaporator 240 is positioned, at least in substantial part, in the first section 273 of the cavity 219, in thermal communication with the packer fluid. The evaporator 240 can include an evaporator entrance end 242 and an evaporator exit end 244. The evaporator entrance end 242 and the evaporator exit end 244 can be mechanically coupled to the equipment housing 230 (described below). Specifically, the evaporator entrance end 242 can be mechanically coupled to the expansion valve 334, and the evaporator exit end 244 can be mechanically coupled to the compressor 332, as shown below in FIG. 3.

If the equipment housing 230 (or, more specifically, the compressor 332 and/or the expansion valve 334) is located in the second section 275 of the cavity 219, then a portion of the evaporator 240 can traverse a channel in the packer 210 and be positioned in the second section 275 of the cavity 219. Similarly, if the equipment housing 230 (and, thus, the compressor 332 and/or the expansion valve 334) is located in the packer 210 or in the first section 273 of the cavity 219, then all of the evaporator 240 can be positioned in the first section 273 of the cavity 219.

In certain example embodiments, the evaporator 240 includes a channel through which working fluid can flow. As used herein, working fluid is a term used for a substance that can efficiently cycle (absorb and give off) heat on a repetitive basis. The working fluid can have specific thermodynamic properties and can be non-corrosive. The working fluid can also be non-toxic, non-flammable, and/or environmentally safe for use. The thermodynamic properties of the working fluid can include a boiling point that is at or slightly below a target temperature, a high heat of vaporization, a moderate density in liquid form, a relatively high density in vapor form, and a high critical temperature. Examples of a working fluid can include, but are not limited to, R141b, R134a, and ammonia.

The evaporator entrance end 242 and the evaporator exit end 244 of the evaporator 240 can be made of the same or different material. The evaporator entrance end 242 and the evaporator exit end 244 can be made of one or more of a number of materials that have suitable properties for efficient heat transfer in a downhole environment. Examples of such material can include, but are not limited to, copper and aluminum. The evaporator entrance end 242 and the evaporator exit end 244 can have one or more of a number of shapes. For example, as shown in FIG. 2, the evaporator entrance end 242 can be a coil that wraps around a section of the tubing 212, while the evaporator exit end 244 can be a substantially linear segment. As another example, the evaporator entrance end 242 and the evaporator exit end 244 can be a plate finned tube that is positioned in the first section 273 of the cavity 219.

The characteristics (e.g., length, thickness, size of channel, material, shape) of the evaporator entrance end 242 and the evaporator exit end 244 can vary based on one or more of a number of factors, including but not limited to the characteristics of the working fluid, the depth of the wellbore, and the characteristics of the packer fluid.

In certain example embodiments, the condenser 250 is positioned, at least in substantial part, in the second section 275 of the cavity 219, in thermal communication with the production fluid. The condenser 250 can include a condenser entrance end 252 and a condenser exit end 254. The condenser entrance end 252 and the condenser exit end 254 can be mechanically coupled to the equipment housing 230 (described below). Specifically, the condenser exit end 254 can be mechanically coupled to the expansion valve 334, and the condenser entrance end 252 can be mechanically coupled to the compressor 332, as shown below in FIG. 3.

If the equipment housing 230 (or, more specifically, the compressor 332 and/or the expansion valve 334) is located in the first section 273 of the cavity 219, then a portion of the condenser 250 can traverse a channel in the packer 210 and be positioned in the first section 273 of the cavity 219, while a majority of the condenser 250 is positioned in the second section 275 of the cavity. Similarly, if the equipment housing 230 (and, thus, the compressor 332 and/or the expansion valve 334) is located in the packer 210 or in the first section 273 of the cavity 219 (as shown in FIG. 2), then all of the condenser 250 can be positioned in the second section 275 of the cavity 219.

In certain example embodiments, the condenser 250 includes a channel through which the working fluid described above with respect to the evaporator 240 can flow. In other words, the condenser 250, along with the evaporator 240, the compressor 332, and the expansion valve 334, form a closed-loop system. The condenser entrance end 252 and the condenser exit end 254 of the condenser 250 can be made of the same or different material. The condenser entrance end 252 and the condenser exit end 254 can be made of one or more of a number of materials that have suitable properties for efficient heat transfer in a downhole environment. Examples of such material can include, but are not limited to, copper and aluminum. The condenser 250 can be made of the same or different materials than the evaporator 240.

The condenser entrance end 252 and the condenser exit end 254 can have one or more of a number of shapes. For example, as shown in FIG. 2, the condenser entrance end 252 can be a coil that wraps around a section of the tubing 212, while the condenser exit end 254 can be a substantially linear segment. As another example, the condenser entrance end 252 and the condenser exit end 254 can be a plate finned tube that is positioned in the second section 275 of the cavity 219. The characteristics (e.g., length, thickness, size of channel, material, shape) of the condenser entrance end 252 and the condenser exit end 254 can vary based on one or more of a number of factors, including but not limited to the characteristics of the working fluid, the depth of the wellbore, and the characteristics of the production fluid.

In certain example embodiments, the equipment housing 230 is positioned within the cavity 219 in either the first section 273 and/or the second section 275. For example, as shown in FIG. 2, the equipment housing 230 is disposed in the second section 275 of the cavity 219. A system 200 can include one or multiple equipment housings 230. The equipment housing can be set in place within the cavity 219 using one or more of a number of features. For example, slips or other types of metal wedges can be used to dig into the inner wall of the casing 214. The equipment housing 230 can be made from one or more of a number of materials, including but not limited to metal, rubber, and plastic.

The equipment housing 230 can house one or more of a number of components of the system 200. For example, the equipment housing 230 can house the compressor 332 and the expansion valve 334. In such a case, the equipment housing 230 can also house the connection of the condenser entrance end 252 and the evaporator exit end 244 to the compressor 332, as well as the condenser exit end 254 and the evaporator entrance end 242 to the expansion valve 334.

In certain example embodiments, the compressor 332 pressurizes the working fluid and circulates the working fluid through the condenser 250. By pressurizing the working fluid, the condenser 250 causes the temperature and the pressure of the working fluid to increase. The compressor 332 can pressurize the working fluid by reducing the volume of the working fluid. The compressor 332 can be of any suitable type (e.g., centrifugal, axial, rotary, reciprocating) and be of any suitable size for the particular system 200 in which it is used. The compressor 332 can run, at least in part, using electric power fed from, for example, the cable 295. For example, the power source 260 can be electrically coupled to the compressor 332 using the cable 295. As described above, the power source 260 can deliver a variable amount of power to the compressor 332.

In certain example embodiments, the expansion valve 334 lowers the pressure of the working fluid as the working fluid passes from the condenser 250 to the evaporator 240. The expansion valve 334 (also called a thermal expansion valve) can be any type of metering device, such as, for example, a capillary tube and a turbine. The expansion valve 334 can be of any suitable type (e.g., internally equalized, externally equalized) and be of any suitable size for the particular system 200 in which it is used. Details of the closed-loop process involving the expansion valve 334 and the compressor 332 are provided below with respect to FIG. 3.

The power cable 295 can provide power generated by a power source to one or more components of the system 200. The power source 260 can be any device (e.g., generator, battery) capable of generating electric power that can be used to operate the compressor 332, the expansion valve 334, and/or the electrical device 290, described below. In certain example embodiments, the power source 260 is electrically coupled to the cable 295. In certain example embodiments, the cable 295 is capable of maintaining an electrical connection between the power source 260 and the compressor 332, the expansion valve 334, and/or the electrical device 290 when such devices are operating.

The power generated by the power source 260 can be alternating current (AC) power or direct current (DC) power. If the power generated by the power source 260 is AC power, the power can be delivered in one phase. The power generated by the power source 260 can be conditioned (e.g., transformed, inverted, converted) by a power conditioner (not shown in FIG. 2, but similar to the power conditioner 270 described below) before being delivered to the cable 295.

In certain example embodiments, a removal system 277 can be disposed in the second section 275 of the cavity 219. The removal system 277 of FIG. 2 can include a power conditioner 270 and an electrical device 290. The optional power conditioner 270 can be disposed within the cavity 219 of the casing 214. For example, as shown in FIG. 2, the power conditioner 270 can be located below the equipment housing 230 in the second section 275 of the cavity 219. The power received by the power conditioner 270 can be the same type of power (e.g., AC power, DC power) generated by the power source 260. The power received by the power conditioner 270 can be conditioned (e.g., transformed, inverted, converted) into any level and/or form required by the electrical device 290 before being delivered to the electrical device 290. For example, if the power conditioner 270 receives single phase AC power, the power conditioner 270 can generate 120V three phase AC power, which is sent to the electrical device 290. As described herein the power conditioned by the power conditioner 270 can be called conditioned power. Similarly, the same or a different power conditioner can be used to deliver conditioned power to the compressor 332 and/or the expansion valve 334.

The electrical device 290 can be electrically coupled to the power conditioner 270. The electrical device 290 uses electric power (conditioned by the power conditioner 270) to operate and perform one or more functions within the wellbore 120. An example of the electrical device 290 can include, but is not limited to, a motor. For example, the electrical device 290 can be a pump assembly (e.g., pump, pump motor) that can pump, when operating, oil, gas, and/or other production fluids from the wellbore 120 through the open distal end 213 of the tubing 212 and up the annulus of the tubing 212 to the surface 102. The electrical device 290 can include a control system that controls the functionality of the electrical device 290. Such a control system can be communicably coupled with a user and/or some other system so that the control system can receive and/or send commands and/or data.

Figure 3:
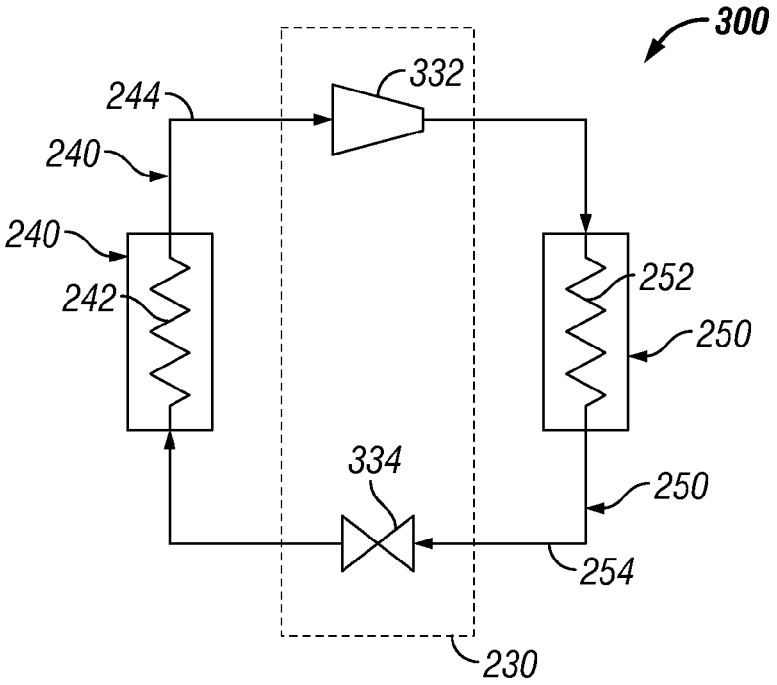
FIG. 3 shows a schematic diagram of a heat exchanger used to heat a production fluid in a wellbore in accordance with certain example embodiments.

FIG. 3 shows a schematic diagram of a heat exchanger 300 used to heat a production fluid in a wellbore in accordance with certain example embodiments. In one or more embodiments, one or more of the features shown in FIG. 3 may be omitted, added, repeated, and/or substituted. Accordingly, embodiments of a heat exchanger used to heat a production fluid should not be considered limited to the specific arrangements of components shown in FIG. 3.

Referring to FIGS. 1, 2, and 3, FIG. 3 shows the closed-loop system of the heat exchanger 300. Starting with the evaporator 240, the working fluid in liquid (and, in some cases, vapor) form travels through the evaporator entrance end 242 of the evaporator, where heat from the packer fluid (external to the evaporator 240) is absorbed by the working fluid through the evaporator entrance end 242.

In certain example embodiments, the packer fluid is heated using heat radiated by the tubing 212. In such a case, the tubing 212 absorbs heat from the production fluid that is flowing through the annulus of the tubing 212 toward the surface 102. As the working fluid absorbs the heat from the packer fluid, the working fluid transforms from liquid form to vapor form. By the time the working fluid flows into the evaporator exit end 244 of the evaporator 240, the working fluid is mostly, if not all, in vapor form.

The working fluid then travels from the evaporator exit end 244 of the evaporator 240 to the compressor 332. As explained above, the compressor 332 pressurizes the working fluid, which increases both the temperature and the pressure of the working fluid. The compressor then sends the working fluid (still in vapor form) to the condenser entrance end 252 of the condenser 250. At this point, the heat from the working fluid is transferred through the condenser 250 to the production fluid (external to the condenser 250), which absorbs the heat. As the production fluid absorbs the heat from the working fluid, the working fluid transforms from vapor form to liquid form. By the time the working fluid flows into the condenser exit end 254 of the condenser 250, the working fluid is mostly, if not all, in liquid form.

The working fluid then travels from the condenser exit end 254 of the condenser 250 to the expansion valve 334. As explained above, the expansion valve 334 depressurizes (lowers the pressure of) the working fluid. In this depressurized and liquefied state, the working fluid can more easily absorb heat. The expansion valve 334 then sends the working fluid (still in at least substantially liquid form) to the evaporator entrance end 242 of the evaporator 240, where the process repeats itself.

In other words, the production fluid below the packer 210 in the cavity 219 is heated by the working fluid flowing through the condenser 250. As the heated production fluid is pumped to the surface through the annulus of the tubing 212, heat is radiated through the tubing 212 to the packer fluid, heating the packer fluid. The heated packer fluid is used to heat, through the evaporator 240, the working fluid, where the heated working fluid returns to the condenser 250 through the compressor 332 to heat the production fluid below the packer 210 in the cavity 219.

Figure 4:
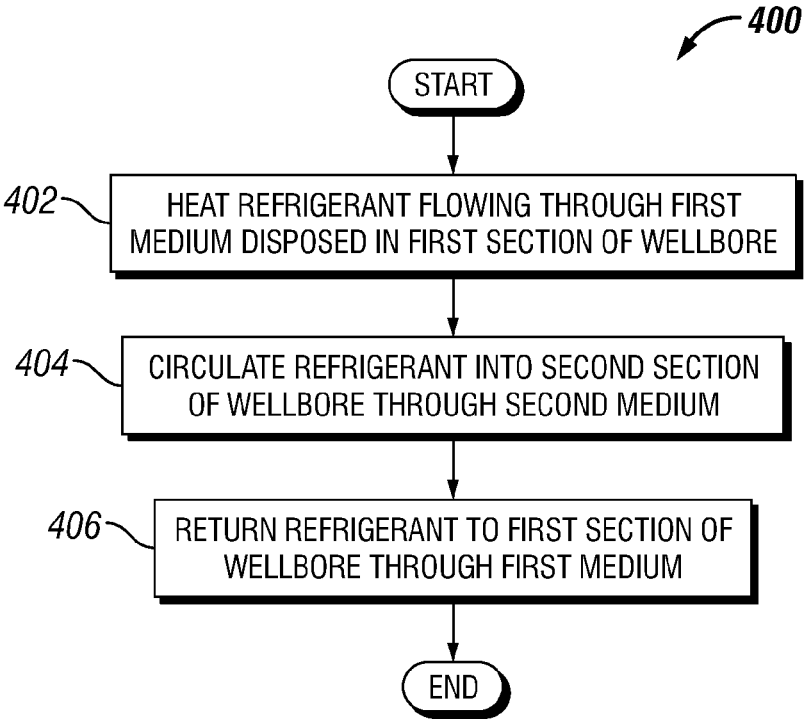
FIG. 4 shows a flowchart presenting a method for heating a production fluid in a wellbore in accordance with certain example embodiments.

FIG. 4 is a flowchart presenting an example method 400 for heating a production fluid in a wellbore in accordance with certain example embodiments. While the various steps in this flowchart are presented and described sequentially, one of ordinary skill will appreciate that some or all of the steps may be executed in different orders, may be combined or omitted, and some or all of the steps may be executed in parallel. Further, in one or more of the example embodiments, one or more of the steps described below may be omitted, repeated, and/or performed in a different order. In addition, a person of ordinary skill in the art will appreciate that additional steps not shown in FIG. 4, may be included in performing this method. Accordingly, the specific arrangement of steps should not be construed as limiting the scope.

Referring now to FIGS. 1, 2, 3, and 4, the example method 400 begins at the START step and proceeds to step 402, where the working fluid flowing through a first medium is heated. In certain example embodiments, the first medium is an evaporator 240. The evaporator 240 can be disposed in a first section 273 of the cavity 219, where the cavity 219 is within the wellbore 120. Further, the evaporator 240 can be in thermal communication with a packer fluid. In such a case, the packer fluid has a higher temperature than the working fluid. Thus, the evaporator 240 transfers heat from the packer fluid to the working fluid.

In certain example embodiments, the working fluid is in vapor form when leaving the first section 273 of the cavity 219 in the wellbore 120 (and, thus, when entering the second section 275 of the cavity 219 in the wellbore 120, as described below). The working fluid can be circulated into the second section 275 of the cavity 219 in the wellbore 120 using a compressor 332. In such a case, the compressor 332 can be disposed at any point within the cavity 219. For example, the compressor 332 can be disposed in the first section 273, in the second section 275, or between the first section 273 and the second section 275.

In step 404, the working fluid is circulated into a second section 275 of the wellbore 120 through a second medium. In certain example embodiments, the second medium is a condenser 250. The condenser 250 can be in thermal communication with the production fluid. In such a case, the production fluid has a lower temperature than the working fluid. Thus, the condenser 250 transfers heat from the working fluid to the production fluid. The heat transferred from the working fluid to the production fluid through the condenser 250 can change at least one property (e.g., temperature, viscosity, state) of the production fluid. For example, the heat transferred from the working fluid can raise the temperature of the production fluid to approximately 250° F. As another example, the heat transferred from the working fluid can change the state of the production fluid from a liquid to a vapor. The heat released by the working fluid through the condenser 250 can cause the working fluid to transform from a vapor state to a liquid state.

In step 406, the working fluid is returned to the first section 273 of the wellbore 120 through the first medium. In certain example embodiments, the method 400 repeats itself. For example, after the working fluid returns to the first section 273 of the wellbore 120, the working fluid flowing through the evaporator 240 is reheated by heat transferred from the packer fluid through the evaporator 240.

In certain example embodiments, the working fluid is in liquid form when leaving the second section 275 of the cavity 219 in the wellbore 120 (and, thus, when entering the first section 273 of the cavity 219 in the wellbore 120, as described above). The working fluid can be circulated into the first section 273 of the cavity 219 in the wellbore 120 using an expansion valve 334. In such a case, the expansion valve 334 can be disposed at any point within the cavity 219. For example, the expansion valve 334 can be disposed in the first section 273, in the second section 275, or between the first section 273 and the second section 275. The heat absorbed through the evaporator 240 by the working fluid can cause the working fluid to transform from a liquid state to a vapor state.

The following description (in conjunction with FIGS. 1 through 4) describes a number of examples in accordance with one or more example embodiments. The examples are for explanatory purposes only and are not intended to limit the scope. Terminology used in FIGS. 1 through 4 may be used in these examples without further reference to FIGS. 1 through 4.

EXAMPLE

In the current state of the art, electrical resistance heaters are used downhole at times in a field operation. Such heaters are typically attached to the outside of the tubing 212 to heat the production fluid as the production fluid flows through the annulus of the tubing 212 to the surface. An example electrical resistance heater can be rated at 67.5 kW. Where the production fluid includes heavy oil, the temperature of the production fluid in the cavity 219 below the packer 210 in the wellbore 120 can be at a temperature of 120° F. (49° C.). At such a relatively low temperature, the production fluid is not very viscous because of the heavy oil. Thus, significant amounts of power are consumed by the electrical resistance heater and/or significant amount of power are consumed by the downhole pump system to extract the production fluid at these low temperatures.

Significant reduction in pumping power could be achieved if the production fluids are heated to a higher temperature (e.g., 250° F., which is equivalent to 120° C.). If the flow rate of the production fluid is such that 67.5 kW of heating will raise the temperature of the production fluid from 49° C. to 120° C., a direct comparison can be made between the example method 400 and system 200 described herein and the electrical resistance heating system known in the art. As a rough estimate, to achieve 67.5 kW of heating, 24 kW of electrical power needs to be supplied to the compressor 332. If the working fluid used in the example is R141b, then the compressor 332 (and thus the example system 200) requires approximately ⅓ of the electrical power required by resistance heaters used for downhole heating in the current state of the art.

The systems, methods, and apparatuses described herein allow for heating production fluid in a wellbore. Example embodiments behave as a heat pump or other type of heat exchanger, where working fluid is circulated through a closed loop system. The working fluid absorbs heat in one section of the wellbore and can change state to a vapor form. The working fluid than releases its heat in a different section of the wellbore to raise the temperature of the production fluid. In such a case, when the working fluid releases its heat, the working fluid can change state to a liquid or a mixture of liquid and vapor.

Using example embodiments described herein, it is possible to control the temperature of the production fluid in a more precise manner. For example, the compressor and/or the expansion valve can be controlled (e.g., speed of the compressor can be changed, power delivered to the compressor can be changed) to control the amount and/or temperature of the working fluid being circulated through the closed-loop system (the evaporator and/or the condenser). Example embodiments can also conserve the amount of energy consumed to heat the production fluid. For example, systems, methods, and apparatuses described herein can use approximately ⅓ the amount of electric power that is used by systems that use electrical resistance heaters.

In addition to heating production fluid, the systems and methods described herein can be used to apply heat in other downhole applications. For example, systems and methods described herein can be used to cause a chemical reaction. As another example, systems and methods described herein can be used to raise the temperature of a hydrate.

Although embodiments described herein are made with reference to example embodiments, it should be appreciated by those skilled in the art that various modifications are well within the scope and spirit of this disclosure. Those skilled in the art will appreciate that the example embodiments described herein are not limited to any specifically discussed application and that the embodiments described herein are illustrative and not restrictive. From the description of the example embodiments, equivalents of the elements shown therein will suggest themselves to those skilled in the art, and ways of constructing other embodiments using the present disclosure will suggest themselves to practitioners of the art. Therefore, the scope of the example embodiments is not limited herein.

What is claimed is:

1. A method for heating a production fluid in a wellbore, the method comprising:

heating, using a packer fluid, in a first section of the wellbore located on a first side of a packer, a working fluid flowing through a first medium disposed in the first section of the wellbore, wherein the first medium transfers heat from the packer fluid to the working fluid;

circulating the working fluid into a second section of the wellbore located on a second side of the packer through a second medium, wherein the second medium transfers heat from the working fluid to the production fluid;

returning the working fluid to the first section of the wellbore through the first medium; and wherein the working fluid stays within the wellbore and wherein the production fluid is separated from the packer fluid by the packer.

2. The method of claim 1, further comprising:

reheating, after the working fluid returns to the first section of the wellbore, the working fluid flowing through the first medium.

3. The method of claim 1, wherein the working fluid is in vapor form when leaving the first section of the wellbore and entering the second section of the wellbore.

4. The method of claim 1, wherein the working fluid is in liquid form when leaving the second section of the wellbore and returning to the first section of the wellbore.

5. The method of claim 1, wherein the working fluid is circulated into the second section of the wellbore using a compressor disposed between the first section and the second section.

6. The method of claim 1, wherein the working fluid is returned to the first section of the wellbore using an expansion valve disposed between the first section and the second section.

7. The method of claim 1, wherein the heat transferred from the working fluid to the production fluid in the second section changes at least one property of the production fluid.

8. The method of claim 7, wherein the at least one property of the production fluid is a temperature, wherein the heat raises the temperature of the production fluid to approximately 250° F.

9. A system for heating a production fluid in a wellbore, the system comprising:

casing disposed within the wellbore and comprising a plurality of perforations for receiving the production fluid from a reservoir adjacent to the plurality of perforations;

tubing disposed within the casing and comprising an open distal end;

a packer disposed between the tubing and the casing at a point above the open distal end of the tubing, wherein the packer creates a first section above the packer and a second section below the packer, wherein the plurality of perforations are disposed within the second section and wherein the packer forms a fluid tight seal between the first section and the second section;

an evaporator disposed in the first section between the tubing and the casing, wherein the evaporator comprises a first channel through which a working fluid flows, wherein the evaporator transfers heat from a packer fluid in the first section to the working fluid; and a condenser mechanically coupled, through the packer, to the evaporator and disposed in the second section between the tubing and the casing, wherein the condenser comprises a second channel through which a working fluid flows, wherein the condenser transfers heat from the working fluid to the production fluid in the second section; and wherein the condenser and evaporator form a closed-loop system.

10. The system of claim 9, further comprising:

a compressor mechanically coupled to an evaporator exit end of the evaporator and a condenser entrance end of the condenser.

11. The system of claim 10, further comprising:

a power source electrically coupled to the compressor.

12. The system of claim 11, wherein the power source delivers a variable amount of power to the compressor.

13. The system of claim 11, further comprising:

an expansion valve mechanically coupled to a condenser exit end of the condenser and an evaporator entrance end of the evaporator.

14. The system of claim 13, wherein the compressor and the evaporator are disposed within an equipment housing.

15. The system of claim 9, wherein the condenser is a coil that wraps around the tubing in the second section.

16. The system of claim 9, wherein the condenser is a plate finned tube.

17. The system of claim 9, further comprising:

a removal system disposed in the second section for sending the production fluid from the second section through the open distal end of the tubing and up an annulus of the tubing.

18. The system of claim 9, wherein the condenser comprises copper.

* * * * *